United States Patent [19]

Steffes

[11] Patent Number: 4,940,271

[45] Date of Patent: Jul. 10, 1990

[54] ENGINE LIFTING METHOD AND TOOL

[75] Inventor: Thomas J. Steffes, Fond du Lac, Wis.

[73] Assignee: Brunswick Corporation, Skokie, Ill.

[21] Appl. No.: 305,739

[22] Filed: Feb. 2, 1989

[51] Int. Cl.[5] ..... B66C 1/10

[52] U.S. Cl. ..... 294/1.1; 411/401

[58] Field of Search ..... 294/1.1, 15; 411/400, 411/401, 389, 384; 403/43, 46, 47, 3

[56] References Cited

U.S. PATENT DOCUMENTS

| | | | |
|---|---|---|---|
| 1,409,524 | 3/1922 | Chase | 411/400 X |
| 2,193,054 | 3/1940 | Bowen | 294/15 |
| 2,361,851 | 10/1944 | La Voy | 294/1.1 X |
| 2,456,917 | 12/1948 | Cheek | 294/15 X |
| 2,500,436 | 3/1950 | Swanson | 294/1.1 X |
| 2,533,894 | 12/1950 | Podell | 403/46 |
| 2,606,054 | 8/1952 | Cole | 294/15 |
| 3,401,804 | 9/1968 | Link | 294/1.1 X |
| 3,492,033 | 1/1970 | Mueller | 294/1.1 X |
| 3,905,633 | 9/1975 | Larson | 294/1.1 |

FOREIGN PATENT DOCUMENTS

| | | | |
|---|---|---|---|
| 1211200 | 2/1986 | U.S.S.R. | 294/1.1 |

OTHER PUBLICATIONS

1986 Repair Manual ST-334-86, General Motors Corp., Medium Duty Truck Unit, Inline 6 Engine, Gasoline 6A2-7, B-07997.

*Primary Examiner*—Margaret A. Focarino
*Assistant Examiner*—Dean J. Kramer
*Attorney, Agent, or Firm*—Andrus, Sceales, Starke & Sawall

[57] ABSTRACT

In an internal combustion engine having a cylinder head, a head cover over the cylinder head, a plurality of studs extending upwardly from the cylinder head within the head cover, and a plurality of head cover bolts extending through respective apertures in the top of the head cover and threadingly engaging respective studs to mount the head cover to the cylinder head, a lifting method and tool are provided wherein one or more of the head cover bolts are removed and temporarily replaced by one or more respective tools each having a lower threaded portion threadingly engaging a respective stud, and an upper hook portion above the head cover for engagement by lifting apparatus for lifting the engine. Particular tool structure is disclosed, as well as various lifting techniques facilitated thereby, including balance point lifting, nonbalance lifting, double anchor lifting and triangulation lifting.

5 Claims, 2 Drawing Sheets

ENGINE LIFTING METHOD AND TOOL

BACKGROUND AND SUMMARY

The invention relates to internal combustion engines, and more particularly to methods and tools facilitating lifting of the engine for installation or removal.

The invention arose from a need to provide an easy manner of lifting a marine diesel engine from its engine bay in the boat, though the invention is not limited thereto. Prior methods typically involved the use of a rope strung beneath the front of the engine. The present invention provides a much simpler and effective method, and uses a simple tool.

DETAILED DESCRIPTION

Prior Art

Figure 1:
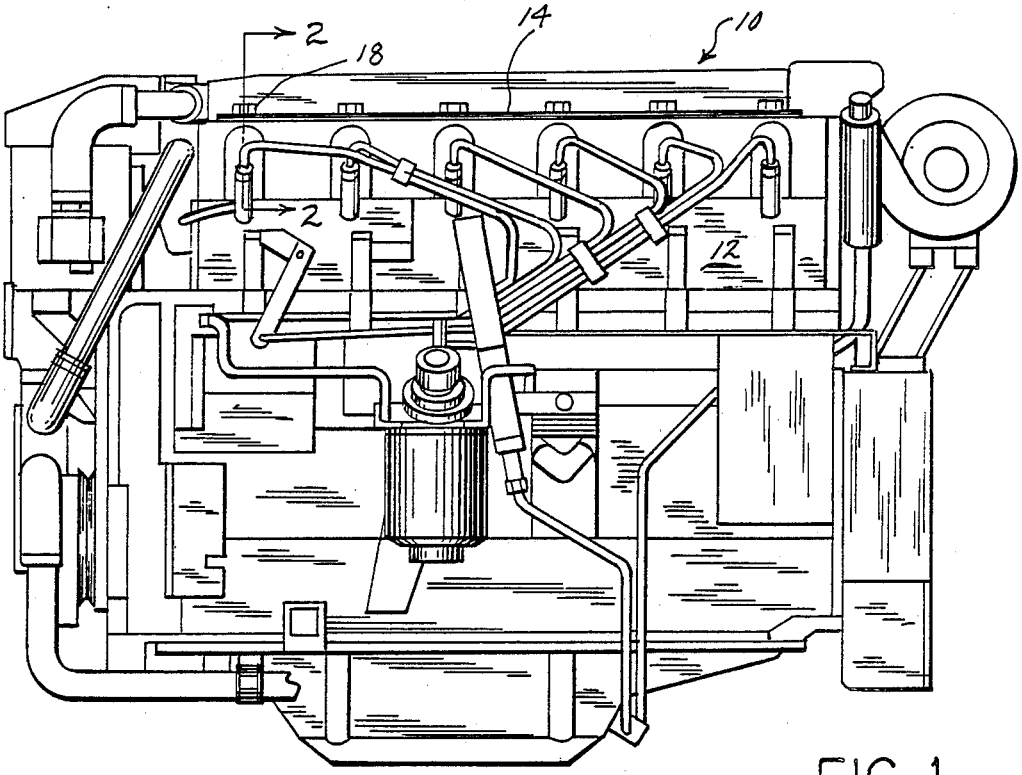
FIG. 1 PRIOR ART
FIG. 1 is a side elevation view of a marine diesel engine known in the prior art.
Figure 2:
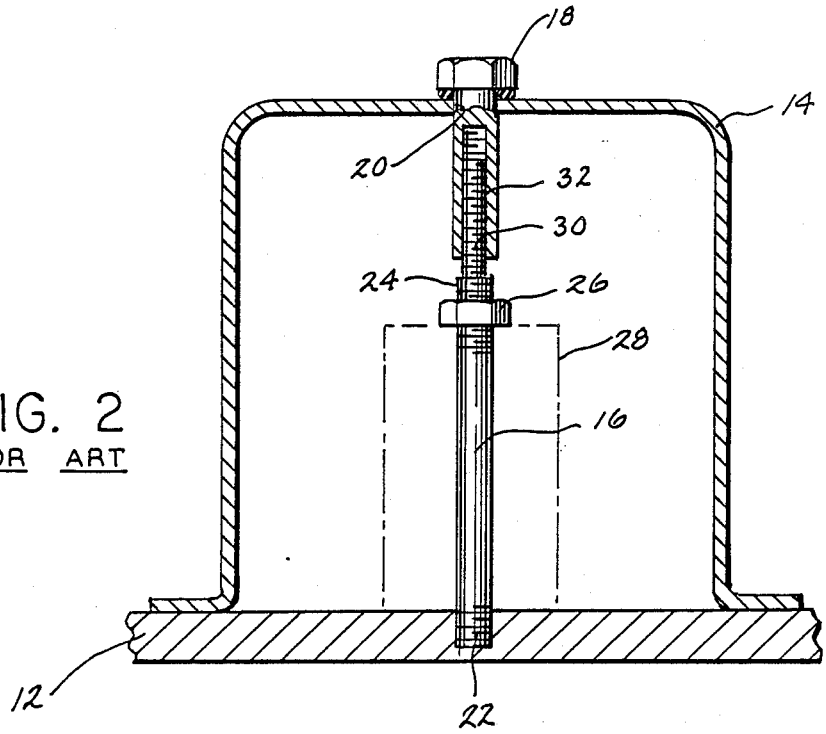
FIG. 2 PRIOR ART
FIG. 2 is an enlarged sectional view taken along line 2—2 of FIG. 1.

FIG. 1 shows an internal combustion engine 10 having a cylinder head 12, FIG. 2, a head cover 14 over the cylinder head, a plurality of studs such as 16 extending upwardly from the cylinder head within head cover 14, and a plurality of head cover bolts such as 18 mating with and extending through respective apertures such as 20 in the top of head cover 14 and threadingly engaging a respective stud to mount head cover 14 to cylinder head 12. Stud 16 has a lower threaded end 22 threaded into head 12, a central threaded portion 24 receiving nut 26 mounting the rocker arm assembly, schematically shown at dashed line 28, to stud 16 and head 12, and an upper reduced diameter threaded portion 30. Bolt 18 has a lower internally threaded portion 32 threaded onto upper stud portion 30 to mount head cover 14 to head 12.

PRESENT INVENTION

Figure 3:
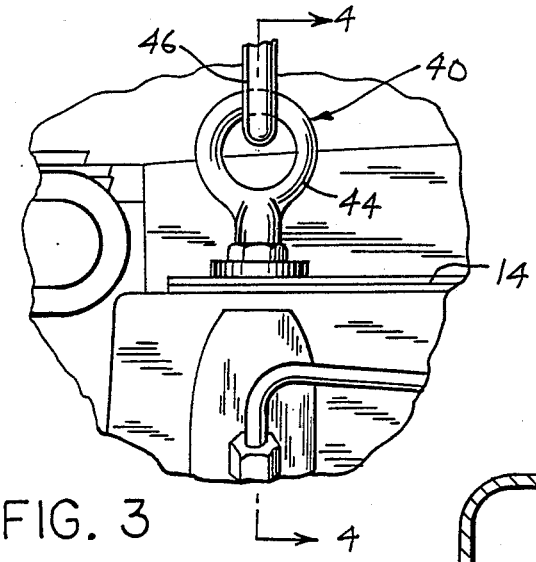
FIG. 3 is an enlarged view of a portion of FIG. 1 and additionally shows the present invention.
Figure 4:
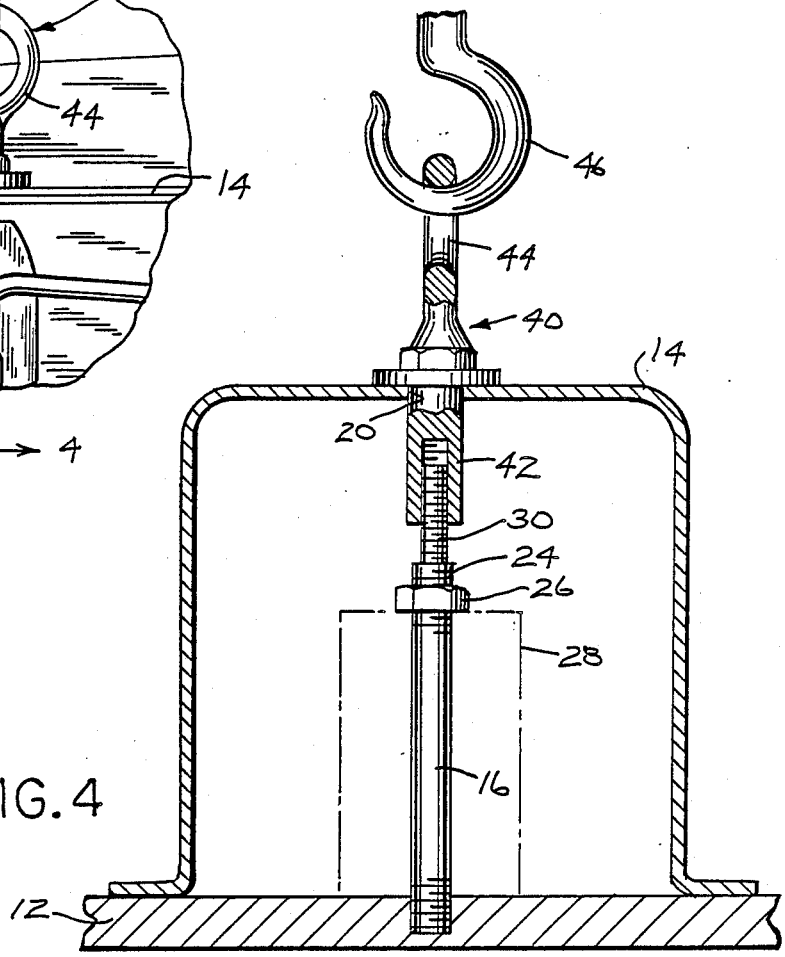
FIG. 4 is a sectional view taken along line 4—4 of FIG. 3.
Figure 5:
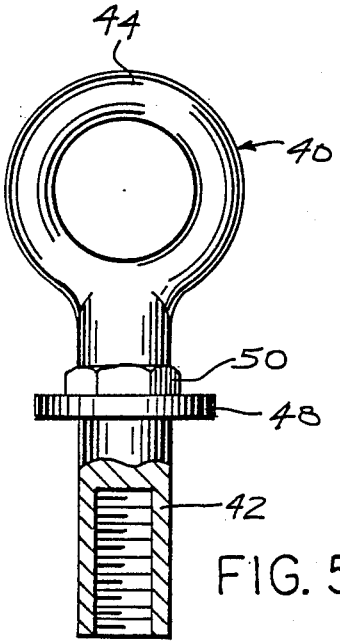
FIG. 5 is a side elevation view, partly in section, of the tool shown in FIGS. 3 and 4.

In the present invention, bolt 18 is removed from stud 16 and temporarily replaced by engine lifting tool 40, FIGS. 3–5. Tool 40 has a lower internally threaded portion 42 threadingly engaging upper portion 30 of stud 16, and an upper hook portion 44 above head cover 14 for engagement by lifting apparatus 46, such as a chain hoist or the like. After the lifting operation, tool 40 is removed by threadingly disengaging lower portion 42 from stud 16, and reinstalling bolt 18.

Upper hook portion 44 of the tool is an eye hook, though other configurations may of course be used. Lower portion 42 of the tool is internally threaded to mate with externally threaded upper stud portion 30, though these roles may be reversed according to the particular engine at hand. The tool has a central flange 48 between upper portion 44 and lower portion 42, which flange covers aperture 20 in the head cover when the tool is installed, to prevent entry of foreign matter through aperture 20 into head cover 14 during the lifting operation. The tool also has a central nut portion 50 between upper portion 44 and lower portion 42, having for example a hex configuration for engagement by a wrench or the like to turn tool 40 for installation and removal of same into and out of threaded engagement with stud 16.

Figure 6:
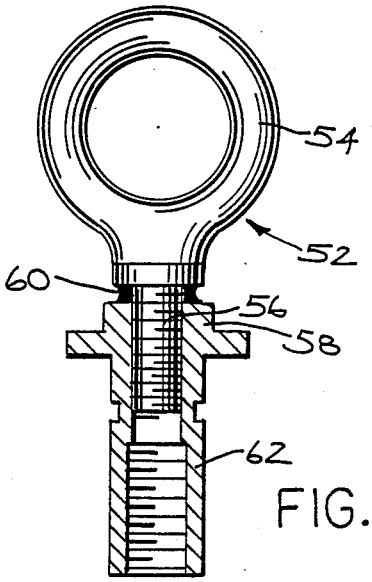
FIG. 6 shows an alternate embodiment of the tool.

In the preferred embodiment, tool 40 is a one-piece member. FIG. 6 shows an alternate embodiment wherein tool 52 is initally a two-piece or a threepiece member and is welded together. Upper hook portion 54 has a lower threaded portion 56 threaded into nut 58 and welded thereto at weld 60. Nut 58 may be a unitary member having a lower internally threaded portion 62, or portion 62 may be welded or otherwise fixed to nut portion 58.

In the preferred method, the head cover bolt selected for temporary replacement by the tool is chosen according to the weight distribution of the engine to provide a proper balance point. If it is desired to lift the engine relatively evenly, then a central balance point is selected. In many diesel engines, because of the weight of the accessories at the front, the front head cover bolt many times provides an even balance point. In other applications where it may be desirable to have non-balanced lifting, i.e. with one end of the engine higher during the lifting operation, the head cover bolt can be selected accordingly. The present invention easily facilitates such flexibility, and greatly expands various lifting options. In other applications, two head cover bolts are temporarily removed and replaced by two tools where desired for a double anchored or other balanced lift. In further embodiments, particularly in engines having a V design or otherwise having a non-in-line cylinder arrangement, three head cover bolts in a triangular pattern are removed and replaced by three tools, providing triangulation during the lifting operation.

It is recognized that various equivalents, alternatives and modifications are possible within the scope of the appended claims.

I claim:

1. A method for lifting an internal combustion engine having a cylinder head, a head cover over said cylinder head, a plurality of studs extending upwardly from said cylinder head in said head cover, and a plurality of head cover bolts mating with respective apertures in the top of said head cover and threadingly engaging respective said studs to mount said head cover to said cylinder head, said method comprising removing at least one of said head cover bolts from its respective said stud and leaving the respective said stud in place in said head cover and attached to said cylinder head, providing a tool having a lower threaded portion and an upper hook portion, replacing said removed head cover bolt with said tool by threading said lower portion of said tool into engagement with said stud such that said upper hook portion of said tool extends above said head cover, engaging said upper hook portion of said tool with lifting apparatus and lifting said engine, removing said tool after said lifting by threadingly disengaging said lower portion of said tool from said stud, and replacing said removed bolt by threading same onto said stud.

2. The invention according to claim 1 comprising selecting said head cover bolt to be removed according to the balance point of said engine, and replacing said last mentioned head cover bolt with said tool providing even balance point lifting of said engine.

3. The invention according to claim 1 comprising selecting said head cover bolt to be removed according to a nonbalance point of said engine, and replacing said last mentioned head cover bolt with said tool providing nonbalanced lifting of said engine, such that one end of said engine is higher during said lifting.

4. The invention according to claim 1 comprising removing two of said head cover bolts and replacing same with two of said tool providing double anchored lifting of said engine.

5. The invention according to claim 1 comprising removing three of said head cover bolts in a triangular pattern and replacing same with three of said tools providing triangulation during said lifting.

* * * * *